US007063414B2

(12) United States Patent
Harakawa

(10) Patent No.: US 7,063,414 B2
(45) Date of Patent: Jun. 20, 2006

(54) INK JET RECORDING APPARATUS

(75) Inventor: Takashi Harakawa, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 233 days.

(21) Appl. No.: 10/749,984

(22) Filed: Dec. 31, 2003

(65) Prior Publication Data

US 2004/0263594 A1 Dec. 30, 2004

(30) Foreign Application Priority Data

Jun. 30, 2003 (JP) ..... 2003-186443

(51) Int. Cl.
*B41J 2/175* (2006.01)

(52) U.S. Cl. ..... 347/93; 347/85

(58) Field of Classification Search ..... 347/85, 347/86, 87, 92, 93
See application file for complete search history.

(56) References Cited

U.S. PATENT DOCUMENTS

| | | | | |
|---|---|---|---|---|
| 5,828,395 | A | 10/1998 | Takata | |
| 5,841,455 | A | 11/1998 | Tanaka et al. | |
| 6,120,140 | A | 9/2000 | Hirosawa et al. | |
| 6,158,855 | A | 12/2000 | Saikawa | |
| 6,270,211 | B1 | 8/2001 | Long et al. | |
| 6,398,354 | B1 * | 6/2002 | Lattuca et al. | 347/93 |
| 6,953,243 | B1 * | 10/2005 | Umeyama et al. | 347/93 |
| 2002/0012034 | A1 | 1/2002 | Saikawa | |

FOREIGN PATENT DOCUMENTS

| | | | |
|---|---|---|---|
| DE | 26 54 049 | A1 | 6/1978 |
| EP | 0930169 | A1 * | 7/1999 |
| JP | 07-117239 | | 5/1995 |
| JP | 09-094978 | | 4/1997 |
| JP | 2001018414 | * | 1/2001 |
| JP | 3168122 | | 3/2001 |
| JP | 2001-239675 | | 9/2004 |

OTHER PUBLICATIONS

European Communication pursuant to Article 96(2) EPC dated Nov. 18, 2005, issued in European Application No. 03 258 258.7.

* cited by examiner

*Primary Examiner*—Anh T. N. Vo
(74) *Attorney, Agent, or Firm*—Frishauf, Holtz, Goodman & Chick, P.C.

(57) ABSTRACT

An ink jet recording apparatus in which a filter F for ink filtration is slanted to a horizontal surface and provided in an ink supply channel communicating with an ink supply port of an ink jet head in a position higher than the ink supply port. In this arrangement, bubbles moved from the ink jet head are collected to a part of the periphery of the filter and easily passed through holes of the filter. As spread and stay of bubbles can be prevented, the ink can be supplied in a stable manner, and further, the occurrence of ink discharge failure can be reliably suppressed.

6 Claims, 4 Drawing Sheets

INK JET RECORDING APPARATUS

CROSS REFERENCE OF THE RELATED APPLICATION

This application is based upon and claims the benefit of priority from the prior Japanese Application No. 2003-186443, filed on Jun. 30, 2003, the entire contents of which are incorporated herein by reference.

BACKGROUND OF THE INVENTION

1. Field of the Invention

The present invention relates to an ink jet recording apparatus which discharges ink as ink droplets.

2. Discussion of the Background

Conventionally, an ink jet recording apparatus such as an ink jet printer performs image formation by discharging ink in an ink jet head as ink droplets from nozzles to a recording medium.

In this ink jet recording apparatus, when the nozzles are clogged with foreign materials or bubbles occur in the ink jet head, ink discharge becomes unstable, or even ink discharge failure occurs, which further causes a problem of poor printing.

To solve the problem, proposed is a method of providing a filter for filtration of ink in an ink supply channel communicating an ink tank with the ink jet head (See United States Patent Application Publication No. US 2002/0012034 A1 (Japanese Patent No. 3168122)). The filter removes foreign materials or the like from the ink. Further, as the filter is slanted to a horizontal surface so as to trap bubbles flowed with the ink from the ink tank, the filter prevents the bubbles from flowing into the ink jet head.

Further, proposed is a method of providing a filter, which removes only foreign materials and passes bubbles, and sucking a nozzle portion of ink jet head, thereby removing the bubbles from the ink jet head (See U.S. Pat. No. 5,828,395 (Japanese Published Unexamined Patent Application No. Hei 9-94978)).

On the other hand, as a characteristic of the filter used in these methods, the absolute filter diameter must be small to trap foreign material of predetermined size. However, in a case where pigment ink is used in the ink jet recording apparatus, the filter may remove the pigment component of the ink, and the filter may be clogged with the pigment component. Generally, an average particle diameter of pigment is about 0.05 to 0.50 μm, however, a pigment particle having a diameter greater than 1 μm exists. The filter used in the ink jet recording apparatus is generally formed by weaving a fine metal line or by metal sintering. Accordingly, the trapping rate of the filter differs by particle diameter, and it varies as shown in a graph of FIG. 8.

In the case where the pigment ink is used in the ink jet recording apparatus, to avoid clogging in the filter, the trapping rate of the filter for the maximum pigment particle diameter must be 0%. In the above-described filter, if the maximum particle diameter is 2 μm, the trapping rate for 2 μm or fewer diameters must be 0%, as shown in FIG. 8, and the trapping rate increases from a particle diameter greater than 2 μm. When a foreign material of 5 μm in size is included in the ink, the material is trapped by the filter with a constant probability. The trapped material is fitted into a clearance of the filter, thus the mesh of the filter is clogged. In the filter of this state, pigment with a particle diameter of 2 μm or less may be trapped. In such case, the trapping rate of the pigment having a particle diameter of 2 μm or less is not 0%.

Further, there is a probability that when the pigment is trapped by the filter, the pigment ink does not satisfy the specification as ink. Further, the trapped pigment accelerates clogging in the filter. On the other hand, in a case where a foreign material of about 100% trapping rate, e.g., a material of about 10 μm in size is included in the ink, the material may break through the filter and have a bad influence within the ink jet head.

In the method disclosed in the U.S. patent application Publication No. US 2002/0012034 A1 (Japanese Patent No. 3168122), as the bubbles flowing with the ink from the ink tank are trapped by the filter, there is no influence on the performance of the ink jet head. However, bubbles occur around the nozzles of the ink jet head, from bubble drawing from the nozzles due to temperature/pressure change, or from a gas dissolved in the ink. The bubbles occurred inside the ink jet head cannot be removed by the above method disclosed in the U.S. patent application Publication No. US 2002/0012034 A1 (Japanese Patent No. 3168122).

Further, in a structure where the filter is horizontally provided, bubbles moved from the ink jet head stay on the filter surface. Even if the amount of bubbles is small, the bubbles spread there form a thin bubble layer. The bubble layer, as a cushion, disturbs ink supply, thus seriously influences ink discharge.

Note that even in the structure in which the filter is slanted, as disclosed in the U.S. patent application Publication No. US 2002/0012034 A1 (Japanese Patent No. 3168122), as bubbles stay on the filter surface and the amount of bubbles gradually increases, an effective filtering area of the filter is narrowed, and the speed of ink filtering is reduced. Further, pressure control necessary for ink supply becomes difficult.

Further, in the method disclosed in the U.S. Pat. No. 5,828,395 (Japanese Published Unexamined Patent Application No. Hei 9-94978), there is a high probability that bubbles are lead in the nozzle portion of the ink jet head. As the bubble absorbs a pressure impact, the mixture of bubble in the nozzle portion seriously degrades the performance of the ink jet recording apparatus.

SUMMARY OF THE INVENTION

Accordingly, it is an object of the present invention to provide an ink jet recording apparatus in which ink can be supplied in a stable manner and the occurrence of ink discharge failure can be reliably suppressed.

The foregoing object is attained by providing a novel ink jet recording apparatus according to the present invention.

In accordance with the novel ink jet recording apparatus according to the present invention, a filter for filtration of ink having plural through holes is provided in an ink supply channel communicating with an ink supply port of an ink jet head, in a position higher than the ink supply port, while the filter is slanted to a horizontal surface, thereby bubbles moved from the ink-jet head are collected to a part of periphery of the filter.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
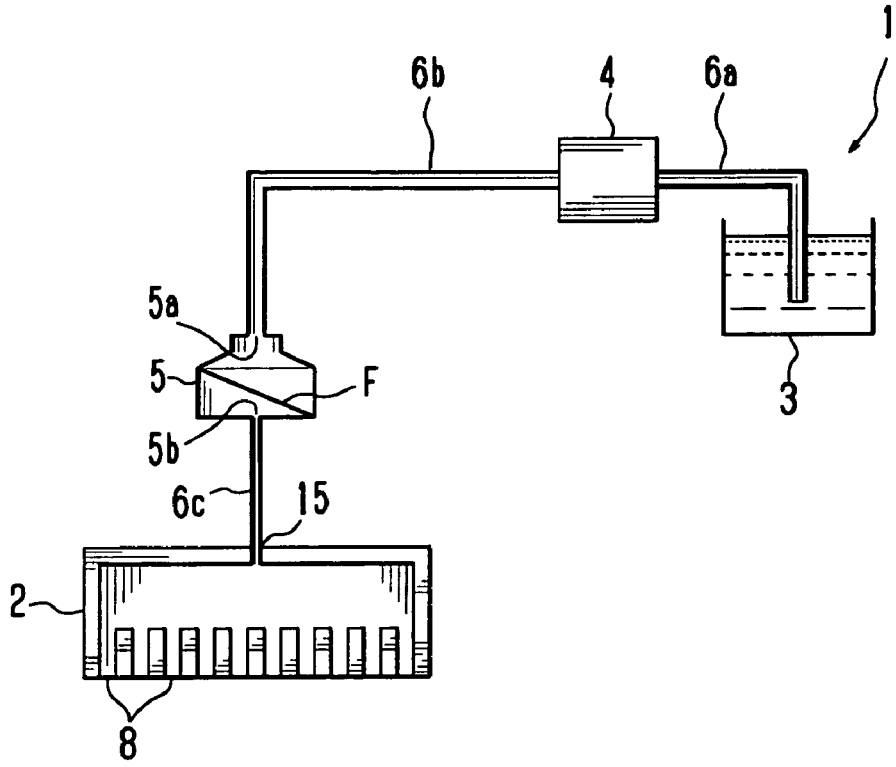
FIG. 1 is an explanatory view schematically showing an ink supply channel in an ink jet recording apparatus according to an embodiment of the present invention.
Figure 2:
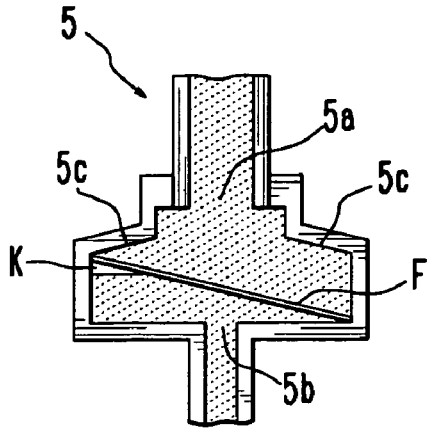
FIG. 2 is a longitudinal sectional view schematically showing the structure of a filter unit.
Figure 3:
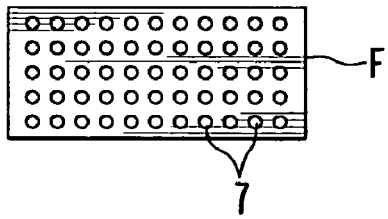
FIG. 3 is a plan view schematically showing a filter.
Figure 4:
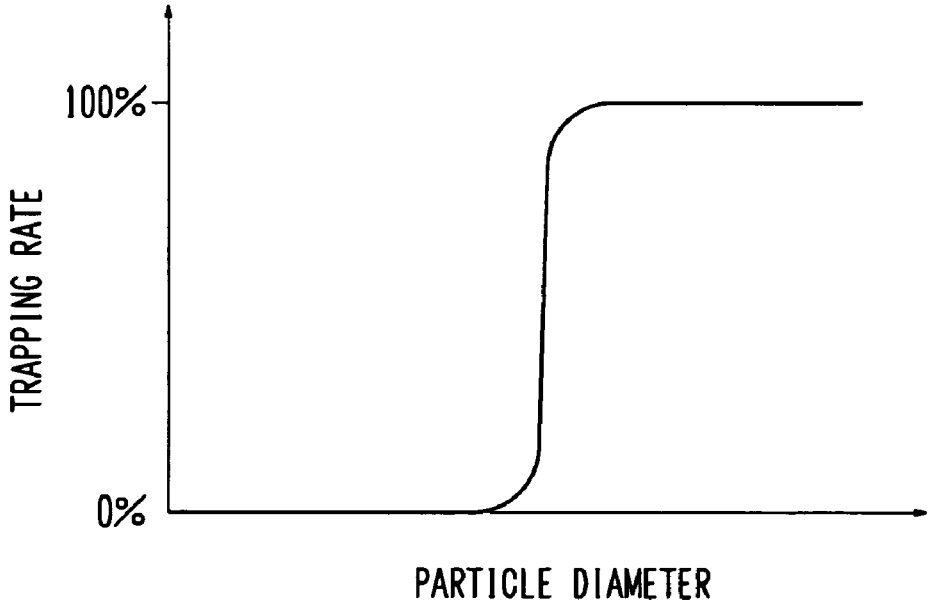
FIG. 4 is a graph showing the filtration accuracy of the filter.
Figure 5:
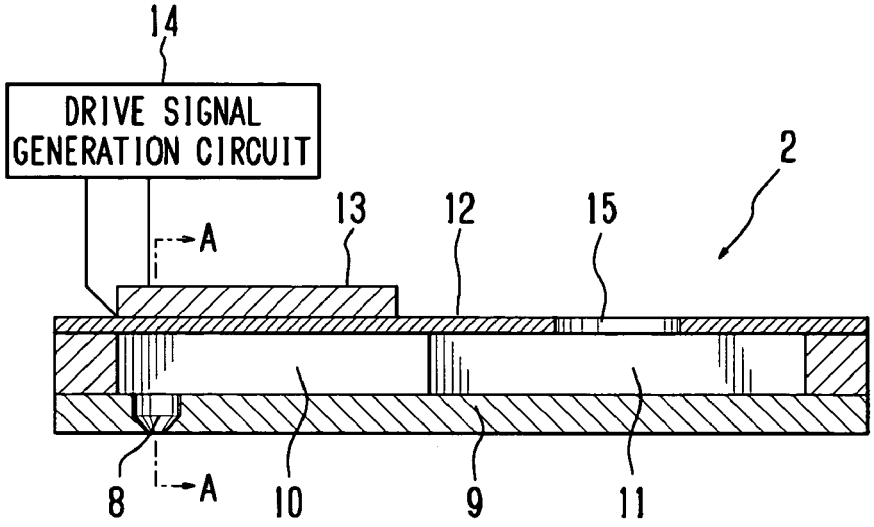
FIG. 5 is a longitudinal sectional view schematically showing an ink jet head.
Figure 6:
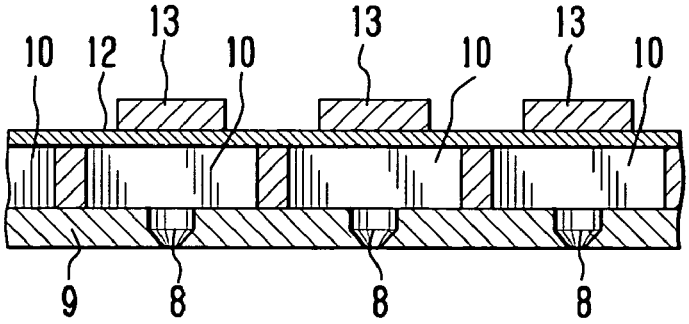
FIG. 6 is a cross sectional view along a line A—A in FIG. 5.

A preferred embodiment of the present invention will now be described in accordance with the accompanying drawings. FIG. 1 is an explanatory view schematically showing an ink supply channel in an ink jet recording apparatus according to an embodiment of the present invention. FIG. 2 is a longitudinal sectional view schematically showing the structure of a filter portion. FIG. 3 is a plan view schematically showing a filter. FIG. 4 is a graph showing the filtration accuracy of the filter. FIG. 5 is a longitudinal sectional view schematically showing an ink jet head. FIG. 6 is a cross sectional view along a line A—A in FIG. 5.

As shown in FIG. 1, an ink jet recording apparatus 1 has an ink jet head 2, an ink tank 3, a liquid pump 4, a filter unit 5 and the like. These elements are interconnected via ink pipes 6*a* to 6*c*. Note that the ink pipes 6*a* to 6*c* function as an ink supply channel through which ink flows.

The ink tank 3 is an ink container holding ink supplied to the ink jet head 2. The ink in the ink tank 3 is supplied via the filter unit 5 to the ink jet head 2 by driving by the liquid pump 4. As the ink to be supplied, pigment ink containing pigment as color material is employed, however, the present invention is not limited to the pigment ink.

As shown in FIGS. 2 and 3, the filter unit 5, including a filter F for ink filtration, removes particles of predetermined size from the ink passing through the filter unit. Note that the filter unit 5, i.e., the filter F, is provided in a position higher than the ink jet head 2 for the purpose of moving bubbles in the ink jet head 2 to the filter unit 5 via the ink pipe 6*c* by buoyancy.

In the filter F, plural through holes 7 having a predetermined diameter are uniformly formed. The filter F, slanted to a horizontal surface, guides and collects the bubbles moved from the ink jet head 2 via the ink pipe 6*c* to a part of the periphery of the filter. Note that the slant angle of the filter F is set to an angle to excellently guide bubbles to the part of the periphery of the filter F. As shown in FIG. 3, the filter F has a rectangular outer shape, however, the present invention is not limited to the rectangular outer shape. For example, the filter may have a round shape. Note that the inner wall of the filter unit 5 is formed in correspondence with the shape of the filter F.

The filter unit 5 is provided with an inflow opening 5*a* connected to the ink pipe 6*b*, which the ink supplied by the liquid pump 4 enters, and an outflow opening 5*b* connected to the ink pipe 6*c*, from which the ink passed through the filter F goes out. Note that the inflow opening 5*a* is a wide opening such that bubbles in the filter unit 5 move to the outside, i.e., the bubbles came from the inflow opening 5*b* into the filter unit 5 and passed through the filter F go to the outside of the filter unit 5. Note that in this example, the inflow opening 5*a* is wider than the outflow opening 5*b*, i.e., the inflow opening 5*a* has a diameter greater than that of the outflow opening 5*b*. Further, the inside of the filter unit 5 is partitioned by the filter F into two parts such that the volumetric capacity on the inflow opening 5*a* side is greater than that on the outflow opening 5*b* side. Further, a slant portion 5*c* is provided inside the filter unit 5 so as to guide bubbles, came from the outflow opening 5*b* into the filter unit 5 and passed through the filter F, to the inflow opening 5*a*.

The ink entered from the inflow opening 5*a* passes the filter F and goes out from the outflow opening 5*b*. By this movement, the ink is filtered by the filter F, thereby foreign materials which cause clogging in nozzles 8, minute particles which become cores of bubbles occurred in the ink jet head 2, or the like, are removed.

Figure 8:
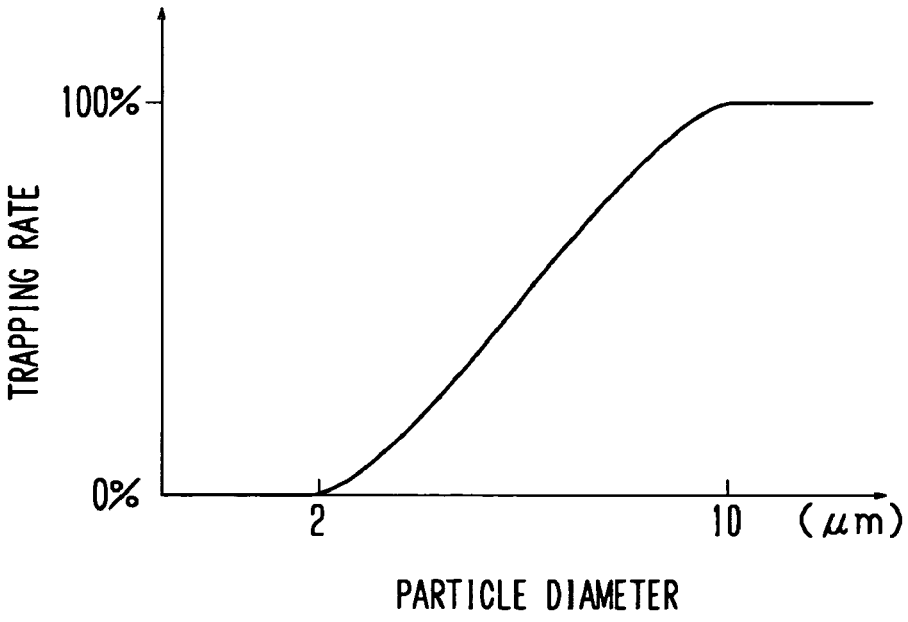
FIG. 8 is a graph showing the filtration accuracy of the conventional filter.

Note that as the filter F of the present embodiment, a filter F formed by a metal plating process is used. The metal plating process is developing a resist formed on a metal base by a photo process, removing the resist except portions of through holes 7, then performing electroplating such as nickel plating and removing the resist, thus forming a metal plate with plural through holes 7 having a predetermined diameter. As the metal plate formed by this process is employed as the filter F, the filter F having a filtration accuracy as shown in FIG. 4 can be obtained. In this filter F, the trapping rate does not gradually increase in accordance with increase in particle diameter as in the conventional filter (See FIG. 8). This filter F, having excellent selectivity in removal of foreign materials and pigment permeation, is very advantageous as the filter F used in the ink jet recording apparatus 1.

Note that in a case where the filter F is horizontally provided, as the smoothness of the surface of the filter F is high, bubbles easily spread under the filter F and form a thin bubble layer. In the present embodiment, to prevent this inconvenience, the filter F is slanted to the horizontal surface. By this arrangement, the bubbles moved from the ink jet head 2 through the ink pipe 6*c* are guided and collected to a part of the periphery of the filter F, and the occurrence of bubble layer can be prevented. Further, as the smoothness of the surface of the filter F is high, the bubbles can be excellently guided and collected in the part of the periphery of the filter F.

As shown in FIGS. 5 and 6, the ink jet head 2 has a nozzle plate 9 where plural nozzles (discharge orifices) 8 are formed, and plural pressure chambers 10 containing ink, provided in positions respectively opposite to the plural nozzles 8. The plural pressure chambers 10 are respectively supplied with ink from a common ink chamber 11. A surface as a part of the pressure chamber 10, opposite to the nozzle plate 9, is formed with a diaphragm 12. The diaphragm 12 is provided with plural piezoelectric members 13 in correspondence with the respective pressure chambers 10.

The plural nozzles 8 are formed on an approximately straight line on the nozzle plate 9. The ink-jet head 2 discharges the ink as ink droplets from the nozzles 8 of the nozzle plate 9. The diaphragm 12 and the piezoelectric members 13 constitute an actuator. The piezoelectric members 13 are electrically connected to an output terminal of a drive signal generation circuit 14. Note that as the piezoelectric member 13, a piezoelectric device (piezo device) is used, however, the present invention is not limited to the piezoelectric device. The diaphragm 12, the piezoelectric members 13 and the drive signal generation circuit 14 constitute drive means for discharging the ink in the pressure chambers 10 as ink droplets from the nozzles 8.

The common ink chamber 11 is provided with an ink supply port 15 connected to the ink pipe 6*c* as an opening to supply the ink. The ink supply port 15 is positioned on the upper side of the ink jet head 2. In this arrangement, bubbles occurred inside the ink jet head 2 can move by buoyancy or the like from the ink supply port 15 into the ink pipe 6*c*. The filter unit 5, i.e., the filter F, is provided in a position higher than the ink supply port 15 of the ink jet head 2. Accordingly, the bubbles in the ink jet head 2 can move by buoyancy via the ink pipe 6*c* to the filter unit 5. That is, the ink jet recording apparatus 1 is arranged such that the bubbles in the ink jet head 2 move by buoyancy or the like to the filter unit 5.

In the ink jet head 2 having the above construction, a drive signal is applied from the drive signal generation circuit 14 to the piezoelectric member 13 to deform the piezoelectric member 13, to vibrate the diaphragm 12. The vibration changes the volumetric capacity of the pressure chamber 10. During the progress of increment of the volumetric capacity of the pressure chamber 10, the ink in the common ink chamber 11 is sucked into the pressure chamber 10, and during the progress of decrement of the volumetric capacity of the pressures chamber 10, the ink in the pressure chamber 10 is discharged from the nozzles 8 as ink droplets to the outside.

Note that in the present embodiment, the piezoelectric members 13 are used as the actuator, however, the present invention is not limited to the piezoelectric members. For example, a heat generator may be employed as an actuator. In this case, the ink jet head has an arrangement where the ink is boiled by the heat generator and is discharged from the nozzle 8 as ink droplets. Further, in the present embodiment, negative pressure is applied to the ink in the nozzle 8 by utilizing the head difference between the liquid surface of the ink reserved in the ink tank 3 and the nozzle 8 in the ink jet head 2. By the operation of the negative pressure, leakage of ink from the nozzle 8 can be prevented.

In this arrangement, bubbles occur in the ink jet head 2 by bubble drawing from the nozzles due to temperature/pressure change, or from a gas dissolved in the ink. The bubbles inside the ink jet head 2 move by buoyancy or the like from the ink supply port 15 of the ink jet head 2 via the ink pipe 6*c* toward the filter unit 5. As the bubbles enter the filter unit 5 from the outflow opening 5*b*, guided and collected to a part of the periphery of the filter F along the surface of the filter F, the occurrence of bubble layer which degrades the filtration accuracy by clogging of the through holes 7 with the spread or stay of bubbles on the surface of the filter F can be prevented. Thus the pressure control necessary for ink supply can be performed in a stable manner, and the decrease of effective filtering area of the filter F can be prevented, and further, the reduction of ink filtration speed can be prevented.

Figure 7:
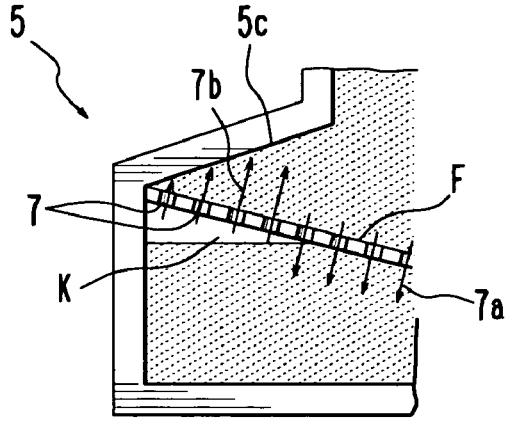
FIG. 7 is a longitudinal sectional view schematically showing an enlarged part of the filter unit.

Further, as shown in FIG. 7, when the size of the bubbles collected in a part of the periphery of the filter F becomes a predetermined size, the bubbles K go through the filter F in an arrow 7*b* direction, by buoyancy or pressure of the ink, and especially pressure of the ink when passing through the filter unit 5 in an arrow 7*a* direction, and then move from the filter unit 5 to the outside. This prevents disturbance of ink supply by the bubbles K collected in the part of the periphery of the filter F, and further, prevents the decrease of effective filtering area of the filter F, and further prevents the reduction of ink filtration speed. In the filter unit 5, as the wettability, the slant angle and the like of the filter F are controlled in consideration of the surface tension and specific gravity of the ink, wettability of the ink to the filter F and the filter diameter and the like, the bubbles K collected to the part of the periphery of the filter F can pass through the filter F.

In this manner, according to the ink jet recording apparatus 1 of the present embodiment, as bubbles moved from the ink jet head 2 to the filter F are collected to a part of the periphery of the filter F and easily passed through the through holes 7 of the filter F, the spread and stay of bubbles on the surface of the filter F can be prevented. Thus ink supply can be made in a stable manner, and further, the occurrence of ink discharge failure can be reliably suppressed. That is, the ink jet recording apparatus 1 can discharge ink in a stable manner. Further, as the filter F with the plural through holes 7 having the filtration accuracy as shown in FIG. 4 is employed, the ink can be filtered with high accuracy. In addition, the bubbles K collected in the part of the periphery of the filter F can be easily passed through the filter F.

Note that in the present embodiment, as the filter F is formed by a metal plating process, the smoothness of the surface of the filter F is high. Accordingly, the bubbles can be excellently guided and collected to the part of the periphery of the filter F. Further, in comparison with a case where the conventional filter is used in the ink jet recording apparatus 1 using pigment ink, as the life of the filter F to the pigment ink is prolonged, a long-life filter F can be realized.

Further, in the present embodiment, as the ink tank 3 as an ink container holds pigment ink containing pigment as the ink, in comparison with dye ink or the like, ink bleeding or color fade-out of ink attached to a recording medium such as a print sheet can be suppressed.

Further, in the present embodiment, the filter unit 5 accommodating the filter F is provided in the ink supply channel constituted with the ink pipe 6*a* to 6*c*. The filter unit 5 has an inflow opening 5*a* which the ink flowing through the ink pipes 6*a* to 6*c* enters and an outflow opening 5*b* from which the ink passed through the filter F goes out. As the inflow opening 5*a* is wider than the outflow opening 5*b* such that bubbles in the filter unit 5 go out to the outside, the bubbles do not stay in the filter unit 5 but excellently go out from the inflow opening 5*a*. Thus, the decrease of the effective filtering area of the filter F can be prevented, and further, the reduction of ink filtration speed can be prevented. By this arrangement, ink supply can be made in a stable manner, and further, the occurrence of ink discharge failure can be reliably suppressed.

Further, in the present embodiment, as the filter unit 5 has the slant portion 5*c* to guide the bubbles in the filter unit 5 to the inflow opening 5*a*, the bubbles in the filter unit 5 can easily move to the inflow opening 5*a*, thus the stay of the bubbles in the filter unit 5 can be prevented.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet recording apparatus, comprising:

an ink container containing ink;

an ink jet head, which includes an ink supply port communicating with the ink container via an ink supply channel, to discharge the ink from a nozzle as ink droplets; and a filter unit, which is provided in the ink supply channel at a position higher than the ink supply port of the ink jet head, and which comprises a filter that includes a plurality of through holes to filter the ink flowing through the ink supply channel;

wherein the filter is slanted in the filter unit with respect to a horizontal surface and is formed by a metal plating process to guide bubbles generated under the filter, downstream of the filter in an ink flowing direction, to a peripheral section of the filter; and wherein the bubbles collected at the peripheral section pass upward through the filter.

2. The ink jet recording apparatus according to claim 1, wherein the filter unit comprises an inflow opening through which the ink flowing through the ink supply channel enters the filter unit and an outflow opening through which the ink passed through the filter exits the filter unit; and wherein the inflow opening is wider than the outflow opening so as to cause bubbles in the filter unit to flow upstream out from the filter unit.

3. The ink jet recording apparatus according to claim 2, wherein the filter unit comprises a slant portion to guide the bubbles in the filter unit to the inflow opening.

4. The ink jet recording apparatus according to claim 3, wherein the ink container holds pigment ink containing pigment as the ink.

5. The ink jet recording apparatus according to claim 2, wherein the ink container holds pigment ink containing pigment as the ink.

6. The ink jet recording apparatus according to claim 1, wherein the ink container holds pigment ink containing pigment as the ink.

* * * * *